US005811788A

United States Patent [19]

Wicke

[11] Patent Number: 5,811,788

[45] Date of Patent: Sep. 22, 1998

[54] INTEGRATED BOOST PHASE AND POST BOOST PHASE MISSILE GUIDANCE SYSTEM

[75] Inventor: Dallas C. Wicke, Garden Grove, Calif.

[73] Assignee: McDonnell Douglas Corporation, Huntington Beach, Calif.

[21] Appl. No.: 744,728

[22] Filed: Oct. 29, 1996

[51] Int. Cl.[6] ..... F41G 7/30

[52] U.S. Cl. ..... 244/3.1; 244/3.14

[58] Field of Search ..... 244/3.1, 3.11, 244/3.14, 3.15, 3.2; 89/1.11; 342/62; 102/374, 377, 380; 60/225, 256

[56] References Cited

U.S. PATENT DOCUMENTS

| | | | |
|---|---|---|---|
| 3,128,600 | 4/1964 | Oldham | 60/256 |
| 3,568,954 | 3/1971 | McCorkle, Jr. | 244/3.2 |
| 3,758,052 | 9/1973 | McAlexander et al. | 244/3.14 |
| 4,387,865 | 6/1983 | Howard et al. | 244/3.1 |
| 4,470,562 | 9/1984 | Hall et al. | 244/3.2 |
| 4,736,583 | 4/1988 | Hudema et al. | 60/256 |
| 5,071,087 | 12/1991 | Gray | 244/3.15 |
| 5,435,503 | 7/1995 | Johnson, Jr. et al. | 244/3.15 |
| 5,467,558 | 11/1995 | Linick | 244/3.11 |

OTHER PUBLICATIONS

John E. White, "Cut–Off Insensitive Guidance with Variable Time of Flight"; Technical Report, Sandia National Laboratories, Jan. 1993.

John E. White, "A Lambert Targeting Procedure for Rocket Systems that Lack Velocity Control"; Technical Report, Sandia National Laboratories, Nov. 1988.

Richard H. Battin, "Lambert's Problem Revisited"; AIAA Journal, vol. 15, No. 5, May 1977.

Jia Peiran and Tang Guojian, Realization of Target Satellite Interception with Velocity Gain Guidance; Technical Report, National Air Intelligence Center, Mar. 1996.

J.A. Lawton and C.A. Byrum, "Antitactical Ballistic Missile Global Effectiveness Model (AGEM) Intercept Algorithm"; Report, Naval Surface Warfare Center, Jul. 1994.

*Primary Examiner*—Charles T. Jordan
*Assistant Examiner*—Christopher K. Montgomery
*Attorney, Agent, or Firm*—Harness Dickey & Pierce P.L.C.

[57] ABSTRACT

An integrated system and method for guiding an inflight missile during its boost phase to increase the accuracy of the missile flight and increase the probability that the missile reaches its intended target. The system includes four sub-systems that each perform a separate missile guidance function, but that each are integrated to form a single guidance system. The system includes a position rectified velocity wire guidance sub-system for steering the missile to maintain the same trajectory as determined in a prelaunch solution through measuring velocity error at a given position along the path of the missile. The system also includes an ignition delay sub-system for correcting missile position along the flight path by navigating position between burnout of the given missile stage and ignition of the subsequent stage, and modifying the ignition time to correct the missile position after all missile stages are burned. The system also includes a multi-node Lambert guidance sub-system for steering the missile through a multi-node Lambert guidance control that arrives at independent solutions based on desired conditions at the target point and one or more way points; then merges the independent solutions. In addition, the system of the present invention includes a post-boost guidance sub-system for guiding the missile through post-boost guidance correction to correct residual velocity error through either a post-boost trans-stage capability or through the inherent capability of the missile.

19 Claims, 4 Drawing Sheets

INTEGRATED BOOST PHASE AND POST BOOST PHASE MISSILE GUIDANCE SYSTEM

BACKGROUND OF THE INVENTION

The present invention relates generally to ballistic missile defense systems, and more particularly, to a guidance system for an interceptor missile that is operative during the boost phase of the missile.

A launched interception missile typically includes guidance and control electronics that follow a set sequence of events. First, the missile is launched based on a prelaunch trajectory solution that satisfies a specified intercept point. Next, as the missile is guided through its boost, or ascent, phase, the system corrects for missile errors, navigation errors, atmospheric winds and other sources of error that tend to steer the missile off course. Also, as the missile advances along its flight path after boost phase termination, onboard missile navigation updates are downlinked to a ground-based missile guidance segment to enable the ground based guidance segment to communicate updates on predicted target position to the missile. Midcourse and terminal missile flight phase guidance corrections are also made prior to the missile reaching its intercept point.

Prior missile guidance systems provide missile guidance target point flight correction by providing additional correction capability, or impulsive velocity, to the missile payload to correct errors accumulated during the booster phase. Additionally, other prior missile guidance systems correct for missile flight errors through position and/or velocity wire guidance communication to the missile flight control system. In another prior system approach, missile thrust termination between the first, second and third flight stages on the missile corrects missile flight errors. Other prior missile guidance control systems control the missile flight path through guidance energy management (GEM) maneuvers which involve an energy wasting maneuver, such as pitching the missile upwardly or downwardly or through a missile corkscrew maneuver.

However, such prior error correction techniques typically increase payload size due to the additional fuel and/or components required to perform the required function. Additionally, certain of the prior error correction techniques, such as the GEM maneuver, require the missile to have a large angle of attack. Therefore, when error correction is performed, large aerodynamic moments are created which in turn add stress to the control capability of the missile.

SUMMARY OF THE INVENTION

The present invention contemplates a method, and corresponding system, for guiding an inflight missile during its boost phase to increase the accuracy of the missile flight and increase the probability that the missile reaches its intended target. The method involves the steps of steering the missile to maintain the same trajectory as determined in a prelaunch solution through measuring velocity error at a given position along the path of the missile. The method also involves correcting missile position along the flight path by navigating position between burnout of the given missile stage and ignition of the subsequent stage, and modifying the ignition time to correct the missile position after all missile stages are burned. The method also provides for steering the missile through use of multi-node Lambert guidance control that arrives at independent solutions based on desired conditions at the target point and one or more way points; then merges the independent solutions. In addition, the method of the present invention provides for guiding the missile through post-boost guidance correction to correct residual velocity error through either a post-boost trans-stage capability or through the inherent capability of the missile.

DETAILED DESCRIPTION OF THE PREFERRED EMBODIMENT

Figure 1:
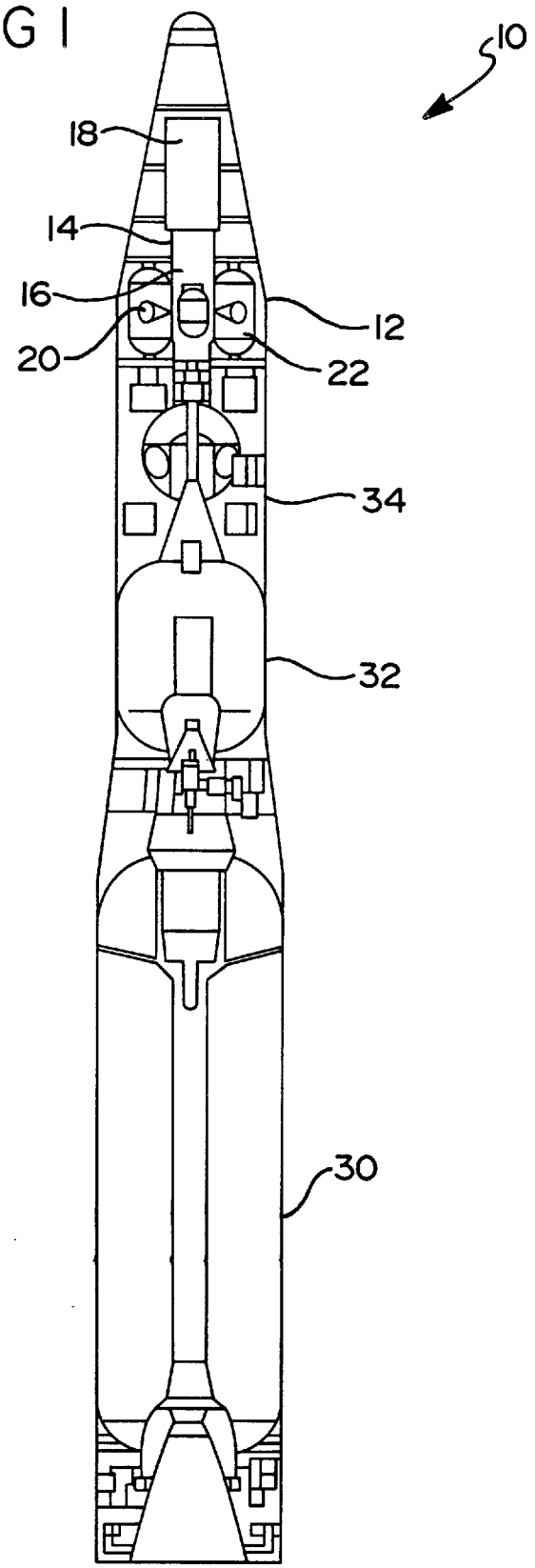
FIG. 1 illustrates a side elevational view, with a portion of its outer shell broken away, of a missile including an integrated boost phase missile guidance system according to the present invention.

Referring now to the drawings, FIG. 1 illustrates a missile in which the preferred embodiment of the present invention may be implemented is shown generally at 10. The missile shown is typical of a strategic defense missile. However, the present invention may also be implemented in any strategic or tactical defense missiles, including surface to air, or conventional space launch vehicles for guidance and control purposes. For purposes of this description, the term "missile" will be used to refer in general to any launched vehicle capable of being guided by the integrated boost phase missile guidance system of the present invention, as described below.

Further referring to FIG. 1, the missile 10 includes a kill vehicle which constitutes the payload, shown generally at 12. The payload includes guidance control electronics 14 and onboard navigation electronics 16 of the type deployed in conventional strategic and tactical defense missiles. The payload also includes additional components, such as a sensor 18. Also located on the payload is a steering mechanism 20 which may be thrustors or other apparatus for adjusting the attitude or angle of attack of the missile in response to commands from the guidance control electronics 14 as will be described in detail below. The payload also includes a propulsion system 22, or post boost phase trans-stage component, including fuel for propelling the kill vehicle to its intended target.

Modular booster stages 30, 32 and 34 are also operatively mounted to the payload 12. Each of the missile booster stages 30, 32 and 34 includes missile fuel and missile propulsion devices such as solid propellant rocket motors for separately propelling the missile along its planned trajectory in three stages, as is well known in the art and as will be described in more detail below. Each booster stage includes control devices such as thrust vector control or reaction type attitude control systems and/or aerodynamic control devices which respond to the guidance and control electronics located in the payload section.

Figure 2:
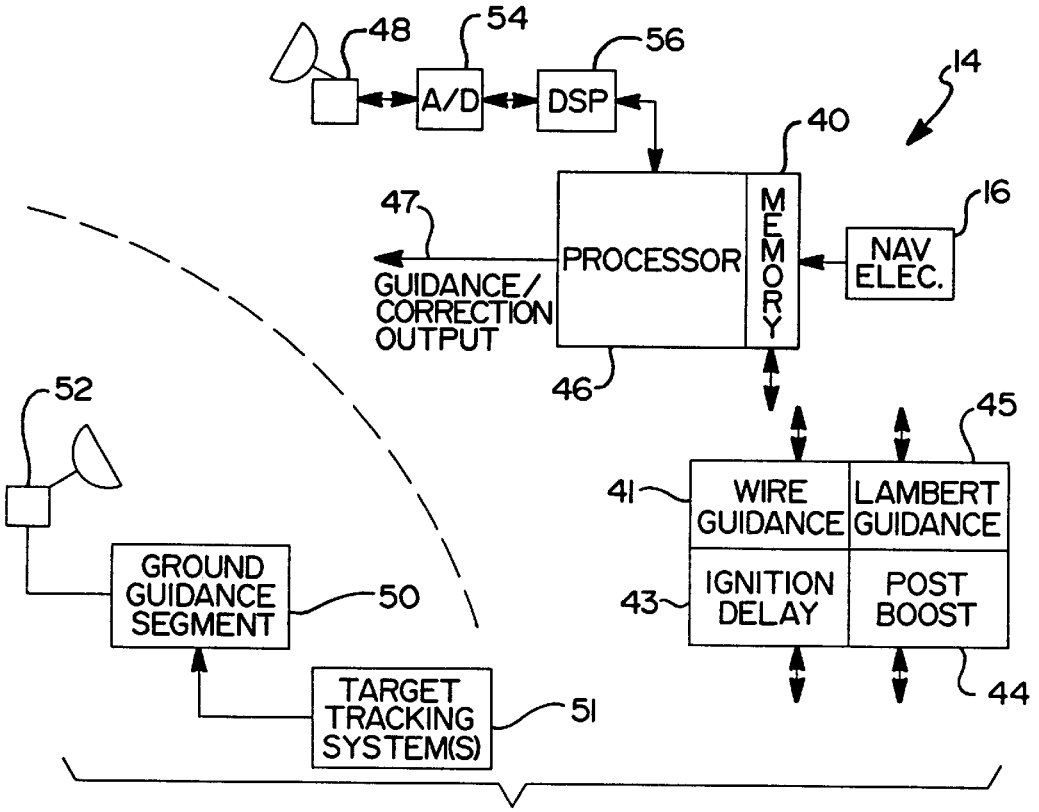
FIG. 2 is a block diagram of the integrated boost phase missile guidance system of the present invention.

Referring to FIG. 2, the diagram of the guidance control electronics 14 is shown. The guidance control electronics includes a memory 40 programmed with the boost phase missile guidance system logic embodied in the command sub-systems 41–44 according to the present invention and a processor 46 having a command output 47 for executing these commands stored in the memory 40. In particular, the memory 40 and the processor 46 implement the sub-systems 41–44 that comprise the boost phase guidance system of the present invention and which will each be discussed below in detail. An antenna 48 of the type RF is operatively connected to the processor 46 for providing a link between the onboard guidance control electronics 14 and a ground based control system 50 with its associated target tracking system 51 and through a ground based antenna 52. The antenna receives analog signals from the ground based antenna 52 which are converted to digital signals through the analog to digital converter 54 and processed through the digital signal processor 56 before being input into the processor 46, as is conventional in the art.

Figure 3:
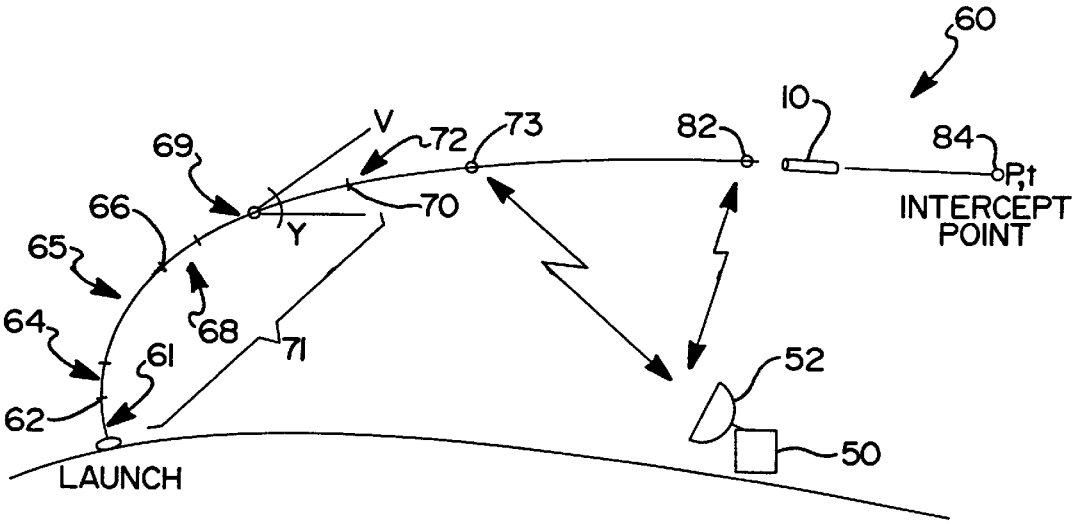
FIG. 3 is a schematic view illustrating the flight path of the missile of FIG. 1.

Referring to FIG. 3, a diagram indicating the various stages of flight of the missile 10 along a missile trajectory is shown generally at 60 and will now be generally described. Initially, as the missile is launched, the first booster stage 30 is ignited and propels the missile through a burn stage 61 until it reaches a burnout stage 62. Subsequently, the missile enters a coast stage 64 until the second booster stage 32 is ignited. The second booster stage 32 subsequently propels the missile through the burn stage 65 until it reaches a burnout stage 66, at which time the missile enters a second coast stage 68. The missile subsequently remains in the coast stage 68 until the third booster stage 34 is ignited. The third booster stage 34 then propels the missile through a third burn stage 69 until it reaches a burnout stage 70. The combination of the three booster stages will be referred to as the missile boost phase 71. Subsequently, the missile enters a third coast stage 72 until the payload passes through a first node 73, at which time the missile guidance and navigational electronics 14, 16 communicate with a ground based guidance segment 50 through the directional antenna 52. As will be explained in more detail below, the ground based guidance system 50 subsequently provides an uplink through the directional antenna 52 to the missile at an inflight target update (IFTU) point 82 to provide final target tracking information to the missile to adjust its intended intercept point 84.

Still referring to FIG. 3, the integrated boost phase missile guidance system of the present invention provides guidance to the missile 10 during its boost phase during which time the missile is progressively propelled at time-varying attitude angles by the three booster stages 30, 32 and 34 to achieve missile velocity represented by the velocity vector V and flight path angle $\gamma$. The system of the present invention is programmed into the memory 40 (FIG. 2) through FORTRAN programming language, or any other software programming language well known to those skilled in the art. The system includes four main sub-systems, each of which will now be described in particular detail, with reference being made to FIGS. 3 and 4 throughout the description of each.

Position Rectified Velocity Wire Guidance Sub-System

Figure 4:
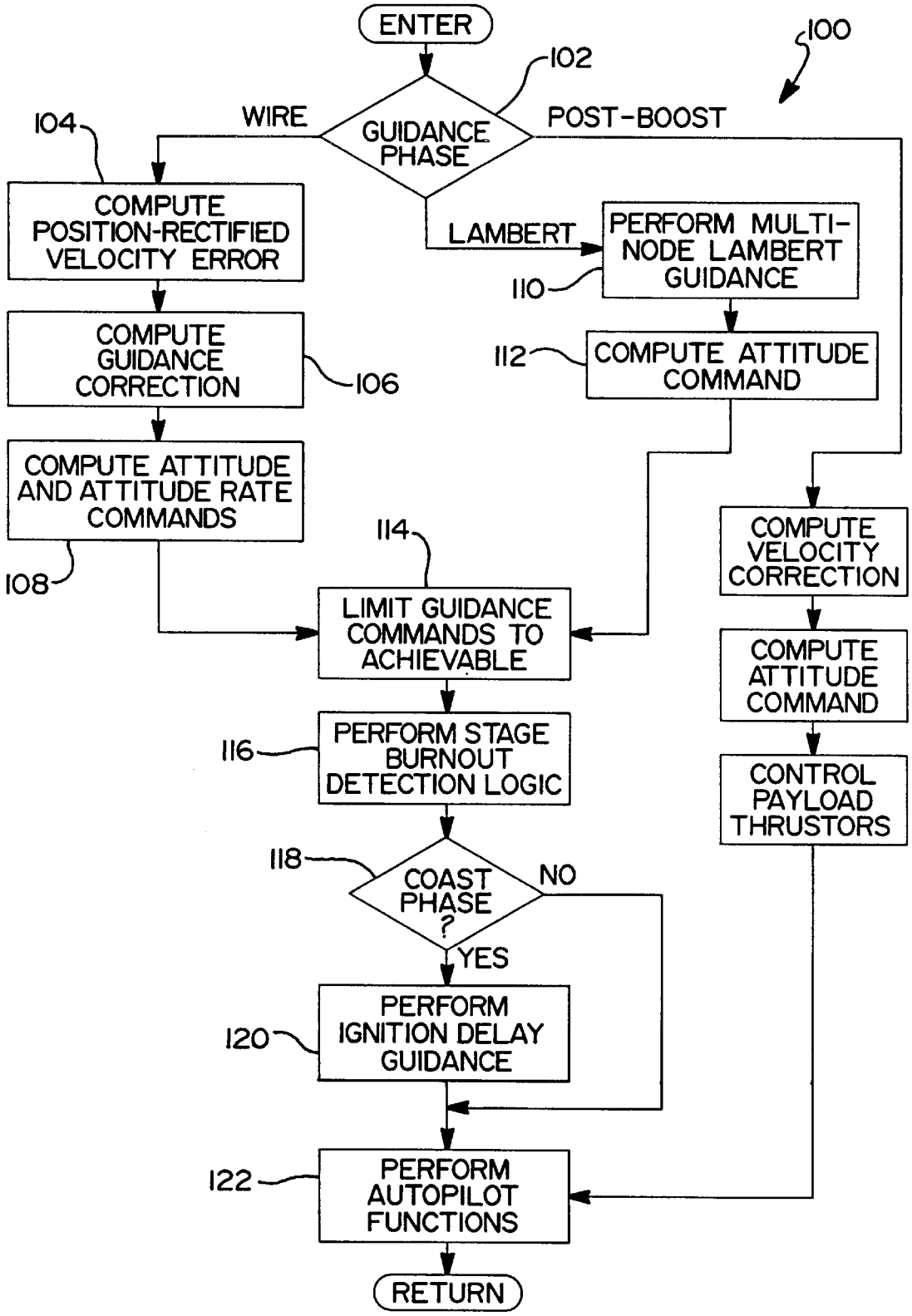
FIG. 4 illustrates a flow diagram of the guidance logic programmed into the on-board missile guidance and control electronics embodied in the system shown in FIG. 2.

Referring to FIG. 4, a flow diagram illustrating the methodology implemented in the four sub-systems of the present invention is shown generally at 100 and will be referred to during description of each of the sub-systems. At step 102, at each guidance cycle, e.g. 20 to 60 times per second, the missile guidance processor executes the appropriate guidance logic path corresponding to the missile guidance phase as indicated at step 102. During the burn stages 61, 65, the first and second booster stages, the missile guidance control electronics compute position rectified velocity error through the wire guidance sub-system 41. The wire guidance sub-system, through the guidance control electronics 14, maintains the same missile trajectory, or wire, as determined in a prelaunch solution programmed into the memory 40 for missile guidance purposes. The measure of merit used to match the trajectory is velocity error measured at a given position along the missile flight path. By basing the velocity error on position rectified velocity, the sub-system maintains the intended radius of curvature of the trajectory 60 at all points.

Thus, the guidance sub-system implicitly satisfies lateral or normal to path position accuracy even though only velocity error is explicitly fed into the guidance logic of the guidance control electronics.

In operation, the wire guidance sub-system 41 receives missile velocity data from on-board navigational electronics 16. At step 104, the sub-system 41 computes position-rectified velocity error by comparing the missile velocity with the velocity determined in the pre-launch solution programmed into the sub-system. In addition, the sub-system also retains missile nominal position and attitude data as calculated in the pre-launch solution. At step 106, the sub-system computes missile guidance correction based on the difference between actual and pre-launch solution missile velocity and navigated position data. The differences computed from these comparisons are fed into guidance logic programmed into memory 40 and executed by processor 46 to produce a desired acceleration correction for the missile. At step 108, this missile acceleration correction is resolved through aerodynamic constants, e.g., normal force coefficients (specific to the missile design) and thrust acceleration to determine a required missile attitude correction relative to nominal, programmed attitude. The sub-system subsequently computes missile attitude rate commands from a nominal rate command program at step 108. These attitude commands and attitude rate commands are then realized through the guidance control electronics which in turn adjust the vehicle attitude through available means such as thrust vector control, reaction type thrustors, or the payload steering mechanism 20. At step 114, the attitude rate commands are limited to achievable parameters by the guidance control electronics.

The wire guidance sub-system 41 maintains the shape of the missile trajectory by comparing missile position at a given time to the pre-launch solution missile position. Thus, at predetermined points along the missile flight path, the sub-system 41 forces the missile shape to achieve the same radius of curvature as the intended missile flight path according to the pre-launch solution. The sub-system compares position errors at equivalent distances along the path but at times that vary from the pre-launch solution ideal time at these particular points. The sub-system includes computer logic for normalizing the actual time versus the equivalent pre-launch solution time computed for the missile at measurement points along the flight path.

Lambert Guidance Sub-System

The Lambert guidance sub-system 42 also operates to guide the missile 10 along its flight path during the boost guidance phase, as shown at step 102 in the flow diagram. However, the Lambert guidance sub-system preferably operates during the third booster stage 68 of the boost phase, and is a velocity based guidance sub-system, as opposed to the position based wire guidance sub-system 41. The sub-system is programmed to compute independent Lambert guidance solutions for guidance nodes, such as the node 73 shown in FIG. 3, which represent a particular time and position point. The computed solutions satisfy the basic Lambert approach:

A velocity correction, when added vectorially to the current velocity shall cause the missile in free flight to pass through a specified position at a specified time. The mathematical solution of the single-point Lambert problem is well documented in the literature of guidance and control and orbital mechanics.

Preferably, the above independent solutions are satisfied at two points on the missile flight path: The intercept point 84 and the intermediate point 73 at which a communication downlink is made. Thus, two Lambert solutions, each of which independently satisfy two desired points of accuracy on the missile flight path, are formed and then combined to produce appropriate missile guidance corrections. This is accomplished by applying time varying weights to each independent solution. The linear combination of independent Lambert solutions for the above two points is as follows:

$$G=aG_I+(1-a)G_{HC}$$

where

G=guidance correction $G_I$=guidance correction to satisfy intercept position and time (e.g., Lambert Δv)

$G_{HC}$=guidance correction to satisfy position and time at planned downlink communication point a=guidance transition factor Referring to FIG. 4, in operation, onboard navigation electronics 16, which are typically aided by Global Positioning Satellite wireless guidance systems, input missile flight path position data into the Lambert guidance subsystem 42 at step 110 at a rate that allows the sub-system to cycle through the linear combination of Lambert guidance solutions approximately 20 to 60 times per second at step 110. The guidance correction solution output from the sub-system is output to the missile guidance electronics, which input the Lambert solutions into missile guidance equations. Solutions from the missile guidance equations are output through the output 47 and are used to adjust missile attitude, as indicated at step 112 in FIG. 4. At step 114, the Lambert solution guidance corrections are limited to achievable parameters by the guidance control electronics.

The Lambert guidance sub-system generates two independent Lambert solutions, the first of which satisfies prelaunch flight conditions at a first way point, indicated at 73 in FIG. 3. This way point serves as a communication downlink point to the ground based guidance control segment 50 via the directional antenna 52. Thus, the position rectified velocity sub-system 41 in conjunction with the Lambert guidance sub-system insures that the missile reaches the first way point 73 accurately so that missile flight information may be downlinked to the ground based guidance segment through the directional antenna to insure accurate pointing of the ground based antenna on subsequent uplink transmissions. Thus, by downlinking missile navigation data to the ground based guidance system, the ground based guidance system is enabled to provide a subsequent inflight target update (IFTU) uplink communication to the missile at 82 in the missile flight path.

The downlink-uplink approach eliminates the necessity of the missile guidance control electronics of guiding the missile through the predetermined IFTU point. The downlinked navigation data is used to predict the actual IFTU position of the missile so that the directional antenna may be adjusted accordingly for an uplink transmission to provide the on-board guidance control electronics with updated target information at the IFTU 82. This prediction is preferably made shortly after burnout of the third booster stage 34 and is based on missile navigation during the coast time subsequent to the burnout of the third booster stage, taking into account post-boost guidance correction, as discussed in more detail below. Thus, while the Lambert guidance subsystem 42 receives updated flight information almost on a continuous basis for cycling through the independent solutions, target information is updated preferably only once at the IFTU 82.

Ignition Delay Sub-System

The ignition delay sub-system 43 operates in a three-stage missile after each stage burnout during coast stage between first and second booster stages and second and third booster stages to adjust the ignition timing of the subsequent booster stage to correct missile position along the missile flight path. However, the sub-system could be programmed to operate during only one or more than two, coast stages, depending upon specific missile configuration. The ignition times for the second and third booster stages are adjusted to compensate for errors accrued in prior booster stages along the vehicle flight path.

As indicated at step 116 in FIG. 4, at the end of each stage, burnout detection logic, which is preferably programmed into the missile guidance control electronics 14, determines the end of the booster stages and the beginnings of the missile coast phases for the second and third booster stages. Burnout detection logic is employed to identify actual burnout time of each booster stage and is important as it is the basis for the logical path to ignition delay guidance sequences. The sub-system requires that nominal coast times be planned between booster stages to allow for either earlier or later ignitions, depending upon the particular missile position along its flight path. If a missile coast stage has been initiated at step 118, at step 120 the ignition delay subsystem 43 performs ignition delay guidance via the on-board guidance electronics by adjusting ignition time of the booster stage in response to data from the on-board navigation electronics 16.

The ignition delay guidance sub-system 43 requires that on-board navigation electronics data is obtained during a vehicle coast stage to insure that the navigation data fully reflects the actual performance of the spent stage and is not corrupted by a partial burning of the next stage. The position error along the path relative to nominal, and a subsequent ignition time adjustment, is computed for the next stage to eliminate position error accumulated up to that point in missile flight and to ensure that completed booster stage performance is taken into account.

The ignition delay sub-system logic is programmed into the memory 40 and includes the following equations used to determine timing of the ignition delay for the second and third stages:

Second Stage Ignition:

$$t_{IG2}=t_{IG2}nom+[(|V|-|Vnom|)(tcomm-t)+(P-Pnom)\cdot\mathrm{unit}(Vnom)]/(V_{G2}+V_{G3})$$

Third Stage Ignition:

$$t_{IG3}=t_{IG3}nom+[(|V|-|Vnom|)(tcomm-t)+(P-Pnom)\cdot\mathrm{unit}(Vnom)]/V_{G3}$$

where $t_{IGi}$=guidance ignition time for stage i $t_{IGi}$nom=nominal ignition time for stage i t=time at which navigation data are taken for ignition guidance (after prior stage burnout) (must also be a time which is in coast period of nominal trajectory)

$t_{comm}$=time at which communication down link is scheduled (for purposes of communicating predicted interceptor position at IFTU time and Health and Status of interceptor after boost)

V=actual velocity at time t

Vnom=nominal velocity at time t

P=actual position vector at time t

Pnom=nominal position vector at time t $V_{GI}$=nominal velocity magnitude to be gained by stage i (in full burn along nominal trajectory)

Ignition adjustments can be positive or negative. Therefore, the nominal trajectory must have additional built-in coast time. The delta coast times for this purpose are as follows:

| | | |
|---|---|---|
| Δtcoast2 | = | built-in coast before second state ignition(preferably about 5 sec) |
| | = | function of nominal flight path angle at first stage burnout |
| Δtcoast3 | = | built-in coast before third state ignition (preferably about 6 sec) |

Post-Boost Guidance Correction Sub-system

A post-boost guidance correction sub-system 44 is incorporated into the missile guidance control electronics 14 to correct residual velocity error, as the sub-systems 41–43 do not correct the component of velocity error in the direction of motion of the missile unless the missile boost stages have thrust termination capability. Thrust termination capability requires additional components to be incorporated into the missile and thus increases cost and limits missile applications. Therefore, the post-boost correction sub-system 44 obviates the need for additional bulky thrust termination components. The sub-system can be realized through either a post-boost trans-stage component or through the inherent capability of the payload propulsion system 22, dependent upon the particular design and application of the missile.

The post-boost guidance sub-system can be realized through either programming of the missile guidance electronics with traditional predictive midcourse guidance equations or by another Lambert solution as discussed above. The residual velocity error corrected by the post-boost guidance system will be closely aligned to the velocity vector V, as the residual errors are primarily errors not capable of being guided out through the second and third stages. The overall effect of the post-boost guidance sub-system will be either to increase or decrease the missile velocity to insure that the missile arrives at the intended target at the correct pre-launch solution time. The payload 12 may have some propulsion or a bus (a correction stage) such as the payload propulsion system 22 for the specific purpose of realizing the error solutions determined by the post-boost guidance sub-system 44.

In operation, at step 126 in FIG. 4, the post-boost guidance sub-system receives residual velocity data from the onboard navigation electronics 16. The sub-system 44, at step 124, determines the missile velocity vector required to insure correct arrival time of the payload at the intended target point. The difference between the required velocity and the actual post-boost velocity is computed and stored in the memory 40 as a velocity correction. At step 126, the guidance control electronics 14 translates the velocity correction into attitude commands which are output 47 to the control system components. At step 128, the guidance control electronics controls thrust impulse demand on the payload propulsion system 22 in order to realize the velocity correction required.

Integration of Sub-Systems

The above four sub-systems are programmed into the guidance control electronics memory 40 in a manner such that each of the sub-systems, while performing an independent function, is integrated with the other three sub-systems to form a single guidance/error correction system. The boost phase guidance system of the present invention thereby is a system in which the separate missile guidance function performed by each of the four sub-systems, in combination with the guidance correction performed by the other three sub-systems, ensures arrival of the missile at the intended intercept point at the correct position and time.

Referring again to FIG. 4, the execution of the guidance logic for each of the guidance phases at each guidance cycle culminates in the performance of autopilot functions at step 122. The guidance control processor 46 translates missile attitude commands into control device deflections or control thrustor activations. The processor also commands discrete control functions such as missile stage ignitions and payload propulsion system firings. The payload propulsion system is preferably of a pulsing type.

Figure 5:
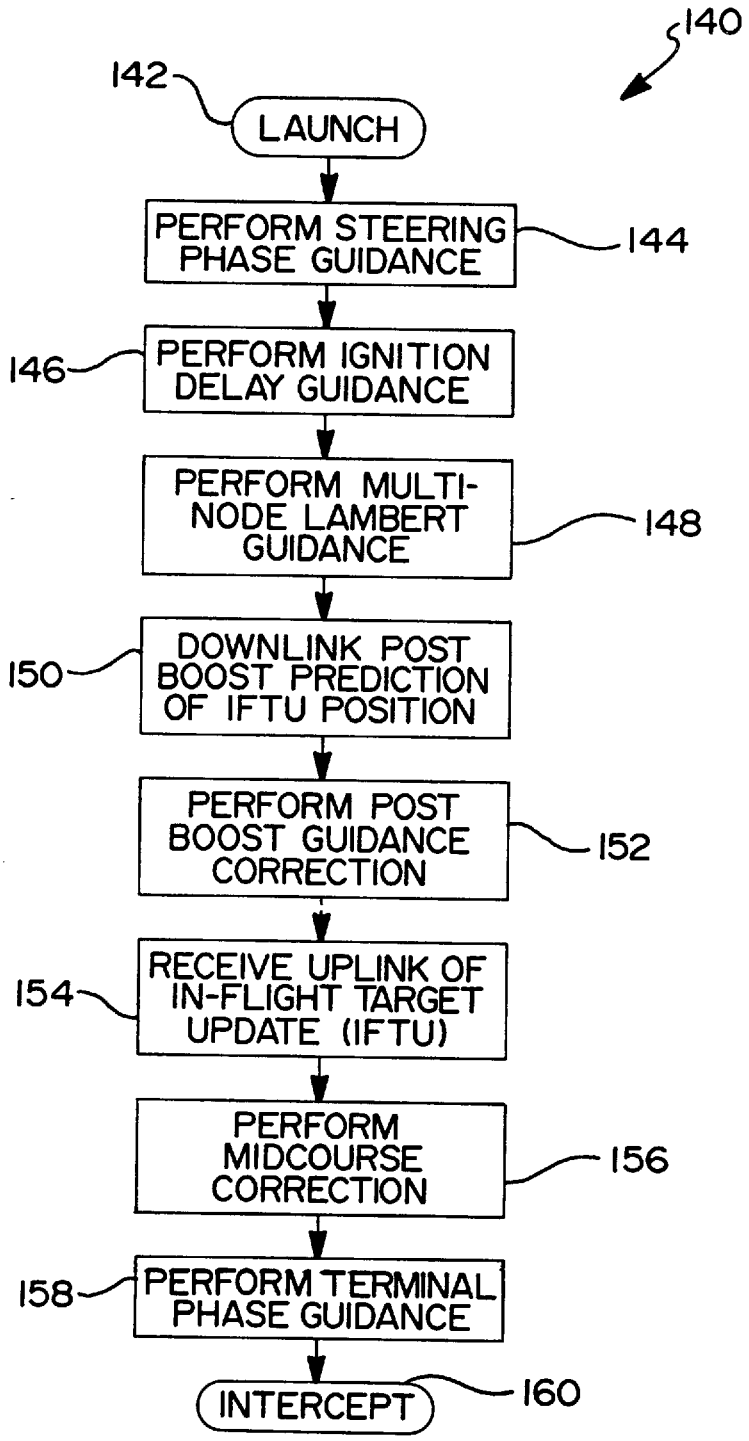
FIG. 5 illustrates a flow diagram illustrating the guidance methodology incorporated in the missile of FIG. 1, including the integrated boost phase missile guidance system of the present invention.

Referring to FIG. 5, a flow diagram illustrating the overall operation of the boost phase guidance system of the present invention is shown generally at 140. At step 142, the missile is launched. At step 144, the position rectified wire guidance sub-system 41 maintains the missile on a correct radius of curvature during the first two booster stages to insure that the missile passes through the first node 73 accurately. At step 146, the ignition delay sub-system 43 forms ignition delay guidance between the first and second stages and the second and third stages as described above to correct any timing errors in the missile along its flight path according to the pre-launch solution. At step 148, the Lambert guidance sub-system 42 determines the net velocity to be gained in vector form and adjusts the missile attitude accordingly during the third missile booster stage. At step 150, the missile downlinks missile position and timing data to the ground guidance system. Propagation of such data to the time of subsequent communications, i.e., IFTU, provides sufficiently accurate direction information for pointing of the ground antenna. At step 152, the post-boost guidance sub-system eliminates accumulated velocity error subsequent to third stage booster burnout. Next at step 154, the missile receives an uplink of inflight target update data which enables the missile to perform a midcourse correction at step 156. At step 158, the terminal phase guidance of the missile is performed prior to intercept of the missile with the target at step 160.

From reading of the foregoing description, it should be appreciated that the integrated boost phase missile guidance system of the present invention provides highly accurate guidance of a missile along a pre-launch determined flight path to an intended target. The present invention is advantageous in that a high degree of trajectory accuracy is obtained with modest guidance system complexity and without incurring the cost and weight penalty of added components associated with alternative guidance approaches. The combination of guidance methodologies used avoids the substantial computational burden of predictive integration guidance approaches. The ignition delay guidance feature avoids the additional cost of thrust termination devices or propellant segmentation.

While the above detailed description describes the preferred embodiment of the present invention, the invention is susceptible to modification, variation and alteration without deviating from the scope and fair meaning of the subjoined claims.

What is claimed is:

1. A method of guiding a missile to an intended target, comprising the steps of:

maintaining a prelaunch determined trajectory by mapping missile flight path velocity to an intended target velocity during a missile boost phase;

measuring missile onboard navigation data during the missile boost phase to determine missile flight path and position error, and generating a plurality of velocity correction signals;

applying said velocity correction signals to cause said missile to pass through a specified position at a specified time during flight;

adjusting missile ignition timing during a missile coast phase, wherein said coast phase is subsequent to an initial boost phase, to cause the ignition of a subsequent boost phase to be delayed or hastened, to correct missile position error accumulated during said coast phase and said initial boost phase;

performing post-boost phase guidance calculations to determine velocity correction signals needed to ensure said missile arrives at said intended target at a predetermined time, and using said velocity correction signals to generate attitude commands to adjust a missile attitude angle to correct missile flight path velocity error; and integrating each of said above steps into a single onboard missile guidance system.

2. The method of claim 1, wherein said step of adjusting said missile booster stage ignition timing comprises the steps of:

determining the end of said initial boost stage and the beginning of said missile coast phase;

obtaining missile navigation data during said missile coast phase; and adjusting said missile ignition timing of said subsequent booster phase to eliminate said accumulated missile position error.

3. The method of claim 2, wherein said step of adjusting missile ignition timing for said subsequent boost phase comprises adjusting missile ignition timing for a second missile booster stage through the following equation:

$$t_{IG2}=t_{IG2}nom+[(|V|-|Vnom|)(t_{comm}-t)+(P-P_{nom})\cdot\mathrm{unit}(Vnom)]/(V_{G2}+V_{G3})$$

where $t_{IGi}$=guidance ignition time for stage i;

$t_{IGi}$nom=nominal ignition time for stage i;

t=time at which navigation data are taken for ignition guidance;

$t_{comm}$=time at which communication down link is scheduled;

V=actual velocity at time t;

Vnom=nominal velocity at time t;

P=actual position vector at time t;

Pnom=nominal position vector at time t; and $V_{GI}$=nominal velocity magnitude to be gained by stage i.

4. The method of claim 2, further comprising adjusting the missile ignition timing for a third missile booster stage through the following equation:

$$t_{IG3}=t_{IG3}nom+[(|V|-|Vnom|)(t_{comm}-t)+(P-P_{nom})\cdot\mathrm{unit}(Vnom)]/(V_{G3}+V_{G3})$$

where $t_{IGi}$=guidance ignition time for stage i;

$t_{IGi}$nom=nominal ignition time for stage i;

t=time at which navigation data are taken for ignition guidance;

$t_{comm}$=time at which communication down link is scheduled;

V=actual velocity at time t;

Vnom =nominal velocity at time t;

P=actual position vector at time t;

Pnom =nominal position vector at time t; and $V_{GI}$=nominal velocity magnitude to be gained by stage i.

5. The method of claim 1, wherein said step of adjusting missile ignition timing comprises incorporating built-in nominal coast times in a prelaunch nominal trajectory, providing allowance for either positive or negative adjustments of coast times for said missile.

6. The method of claim 1, wherein said step of adjusting missile attitude angle comprises computing a missile guidance correction factor through a linear combination of Lambert solutions.

7. The method of claim 6, wherein said linear combination of Lambert solutions is computed through the following equation:

$$G=aG_I+(1-a)G_{HC}$$

where

G=guidance correction;

$G_I$=guidance correction to satisfy intercept position and time (e.g., Lambert Δv);

$G_{HC}$=guidance correction to satisfy position and time at a planned downlink communication point; and a—guidance transition factor.

8. The method of claim 7, further comprising the step of defining the guidance transition factor a through the following parameters:

$$a=0 \qquad (t\leq t_G)$$

$$a=(t-t_G)/(t-t_G) \qquad (t_G<t<t_T)$$

$$a=1 \qquad (t\geq t_T)$$

where t=time from interceptor launch;

$t_G$=time of Lambert guidance start (shortly after third stage ignition); and $t_T$=time of guidance law transition completion.

9. The method of claim 1, wherein said step of adjusting said missile attitude angle during the post-boost phase comprises the steps of:

communicating missile position and time information to a ground based guidance system; and receiving updated intercept point information from said ground based guidance system based on said missile position time information.

10. The method of claim 1, wherein said step of maintaining a prelaunch determined trajectory comprises measuring velocity error at a predetermined missile flight path position; and adjusting missile attitude to correct said missile velocity error.

11. The method of claim 10, further comprising the step of correcting post-boost phase missile residual velocity error through post-boost means.

12. A method of guiding a missile to an intercept point, comprising the steps of:

comparing missile velocity at a predetermined point on a flight path to a predetermined missile target velocity;

correcting said missile velocity in response to said step of comparing missile velocity to thereby maintain a prelaunch solution missile trajectory;

obtaining onboard missile navigation data during a missile coast stage to determine missile flight path and position error experienced during said coast stage and a previous boost stage executed prior to said coast stage, and generating velocity correction signals;

modifying the time of ignition of a boost stage subsequent to said coast stage to correct for said missile flight path position error accumulated during said coast stage and said previous boost stage;

downlinking missile flight information to a central control means;

at said central control means, awaiting said missile flight information for communication antenna pointing purposes;

uplinking updated intercept point information derived from target tracking data to said missile to adjust said missile flight path; and integrating said above steps into a single onboard missile guidance system.

13. A missile guidance system, comprising:

a position rectified velocity correction sub-system that maintains missile trajectory through comparison of missile flight path position at a given time to a prelaunch solution missile flight path position, and that corrects any deviation therefrom;

a Lambert guidance sub-system programmed to compute a linear combination of independent Lambert guidance solutions for at least two guidance nodes to maintain correct missile velocity through missile attitude adjustment; and an ignition delay sub-system for maintaining correct missile flight path location in accordance with the missile prelaunch solution through missile booster stage ignition adjustment;

said above sub-systems being integrated into a single missile guidance system to insure arrival of said missile at a prelaunch solution intercept point.

14. The system of claim 13, wherein said Lambert guidance sub-system computes guidance error corrections through the following equation:

$$G=aG_I+(1-a)G_{HC}$$

where

G=guidance correction;

$G_I$=guidance correction to satisfy intercept position and time;

$G_{HC}$=guidance correction to satisfy position and time at planned downlink communication point; and a—guidance transition factor.

15. The system of claim 14, wherein said guidance transition factor a is defined as follows:

$$a=0 \qquad (t\leq t_G)$$

$$a=(t-t_G)/(t_T-t_G) \qquad (t_G<t<t_T)$$

$$a=1 \qquad (t\geq t_T)$$

where t=time from interceptor launch;

$t_G$=time of Lambert guidance start; and $t_T$=time of guidance law transition completion.

16. The system of claim 13, wherein said ignition delay sub-system computes ignition timing for a second missile booster stage through the following equation:

$$t_{IG2}=t_{IG2}\text{nom}+[(|V|-|Vnom)(t_{comm}-t)+(P-Pnom)\cdot\text{unit}(Vnom)]/(V_{G2}+V_{G3})$$

where $t_{IGi}$=guidance ignition time for stage i;

$t_{IGi}$nom=nominal ignition time for stage i;

t=time at which navigation data are taken for ignition guidance;

$t_{comm}$=time at which communication down link is scheduled;

V=actual velocity at time t;

Vnom=nominal velocity at time t;

P=actual position vector at time t;

Pnom=nominal position vector at time t; and $V_{GI}$=nominal velocity magnitude to be gained by stage i.

17. The system of claim 13, wherein said ignition delay sub-system computes ignition delay for a third missile booster stage through the following equation:

$$t_{IG3}=t_{IG3}\text{nom}+[(|V|-|Vnom|)(t_{comm}-t)+(P-Pnom)\cdot\text{unit}(Vnom)]/(V_{G2}+V_{G3})$$

where $t_{IGi}$=guidance ignition time for stage i;

$t_{IGi}$nom=nominal ignition time for stage i;

t=time at which navigation data are taken for ignition guidance;

$t_{comm}$=time at which communication down link is scheduled;

V=actual velocity at time t;

Vnom=nominal velocity at time t;

P=actual position vector at time t;

Pnom=nominal position vector at time t; and $V_{GI}$=nominal velocity magnitude to be gained by stage i.

18. The system of claim 13, wherein said position rectified velocity sub-system includes a control system for achieving a missile attitude relative to nominal for missile velocity correction.

19. The system of claim 18, wherein said control system is selected from a group consisting of thrust vector control devices, reaction control thrusters, and aerodynamic control devices.

* * * * *

UNITED STATES PATENT AND TRADEMARK OFFICE

CERTIFICATE OF CORRECTION

PATENT NO. : 5,811,788

DATED : September 22, 1998

INVENTOR(S) : Dallas C. Wicke

It is certified that error appears in the above-identified patent and that said Letters Patent is hereby corrected as shown below:

ON THE TITLE PAGE insert the following statement after the title:

"The U.S. Government has a paid-up license in this invention and the right in limited circumstances to require the patent owner to license others on reasonable terms as provided for by the terms of contract DASG60-90-C-0166 awarded by the U.S. Air Force"

Signed and Sealed this

Second Day of March, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,811,788
DATED : September 22, 1998
INVENTOR(S) : Dallas C. Wicke

It is certified that error appears in the above-identified patent and that said Letters Patent is hereby corrected as shown below:

Column 1, line 4, insert the following:

"The U.S. Government has a paid-up license in this invention and the right in limited circumstance to require the patent owner to license others on reasonable terms as provided for by the terms of contract DASG60-90-C-0166 awarded by the U.S. Army."

This certificate supersedes Certificate of Correction issued March 2, 1999.

Signed and Sealed this

Sixteenth Day of May, 2000

*Attest:*

Q. TODD DICKINSON

*Attesting Officer*

*Director of Patents and Trademarks*